US009598912B2

(12) United States Patent
Huang et al.

(10) Patent No.: US 9,598,912 B2
(45) Date of Patent: Mar. 21, 2017

(54) RISER JOINT CONNECTION

(71) Applicant: DMAR ENGINEERING, INC., Houston, TX (US)

(72) Inventors: Zhiming Huang, Missouri City, TX (US); Dagang Zhang, Houston, TX (US)

(73) Assignee: DMAR Engineering, Inc., Houston, TX (US)

( * ) Notice: Subject to any disclaimer, the term of this patent is extended or adjusted under 35 U.S.C. 154(b) by 35 days.

(21) Appl. No.: 14/599,523

(22) Filed: Jan. 18, 2015

(65) Prior Publication Data

US 2016/0208563 A1 Jul. 21, 2016

(51) Int. Cl.
*E21B 17/046* (2006.01)
*E21B 17/08* (2006.01)

(52) U.S. Cl.
CPC ..... *E21B 17/085* (2013.01)

(58) Field of Classification Search
CPC ..... E21B 17/046; E21B 17/01; E21B 19/002
USPC ..... 166/344
See application file for complete search history.

(56) References Cited

U.S. PATENT DOCUMENTS 4,589,689 A * 5/1986 Regan ..... E21B 17/01 285/101
4,683,944 A * 8/1987 Curlett ..... E21B 17/003 166/65.1
6,467,545 B1 * 10/2002 Venkataraman ..... E21B 17/01 166/355

* cited by examiner

*Primary Examiner* — Matthew R Buck
*Assistant Examiner* — Patrick Lambe
(74) *Attorney, Agent, or Firm* — Liaoteng Wang

(57) ABSTRACT

Apparatus and methods related to riser joint connection are described. For example, some embodiments may contain a central coupler, a plurality of reaction collars, collar stoppers, collar caps, and C-rings, for connecting riser joints.

18 Claims, 5 Drawing Sheets

RISER JOINT CONNECTION

FIELD OF PRESENT DISCLOSURE

This present disclosure relates to riser joint connection.

BACKGROUND INFORMATION

Risers are commonly used to provide a flow path between subsea reservoir and topside facility. A typical riser string has many riser joints, using various couplings. Usually, in terms of both strength and fatigue, riser joint connections are the weak points in a riser string. As risers are used tinder increasingly harsher environments, such as situations demanding higher tension load, higher bending load, higher internal pressure, and higher dynamic fatigue load, making riser joint connections that can withstand such harsher conditions has become a challenge. Apparatus and methods have been proposed for making riser joint connections that can meet the challenge.

DETAILED DESCRIPTION

Figure 1:
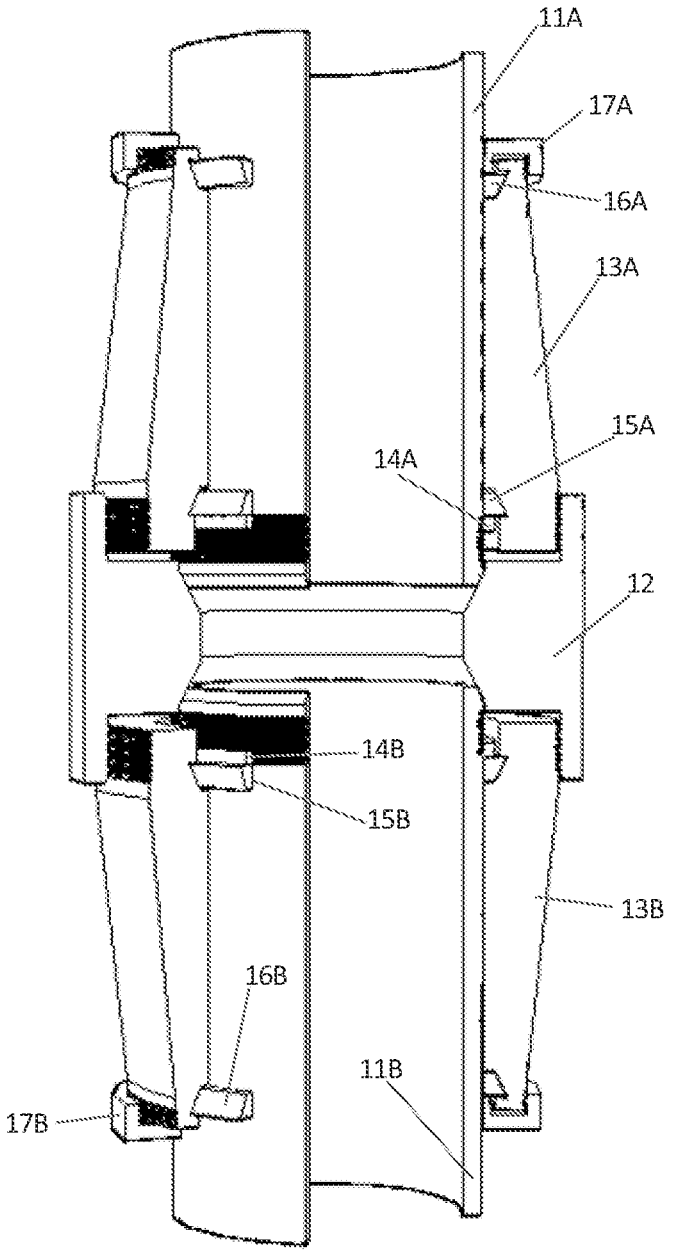
FIG. 1 is a diagram showing the overview of an embodiment of the riser joint connection.

This document discloses apparatus and methods related to riser joint connection. FIG. 1 shows an implementation of the apparatus and methods for riser joint connection, which include a central coupler 12, two reaction collars 13A and 13B, two collar stoppers 14A and 14B, which can be mounted to the outer surface of the riser joints 11A and 1113 through, for example, threaded sections, two collar caps 17A and 17B, and four C-rings 15A, 15B, 16A, and 16B. Riser joints 11A and 11B are in contact with the central coupler 12 to form a seating surface. C-rings 15A and 16A, and C-rings 15B and 16B are in contact with the outer surface of the riser joints 11A and 11B and the inner surface of the reaction collars 13A and 13B, respectively, to form a load bearing surface.

Figure 2:
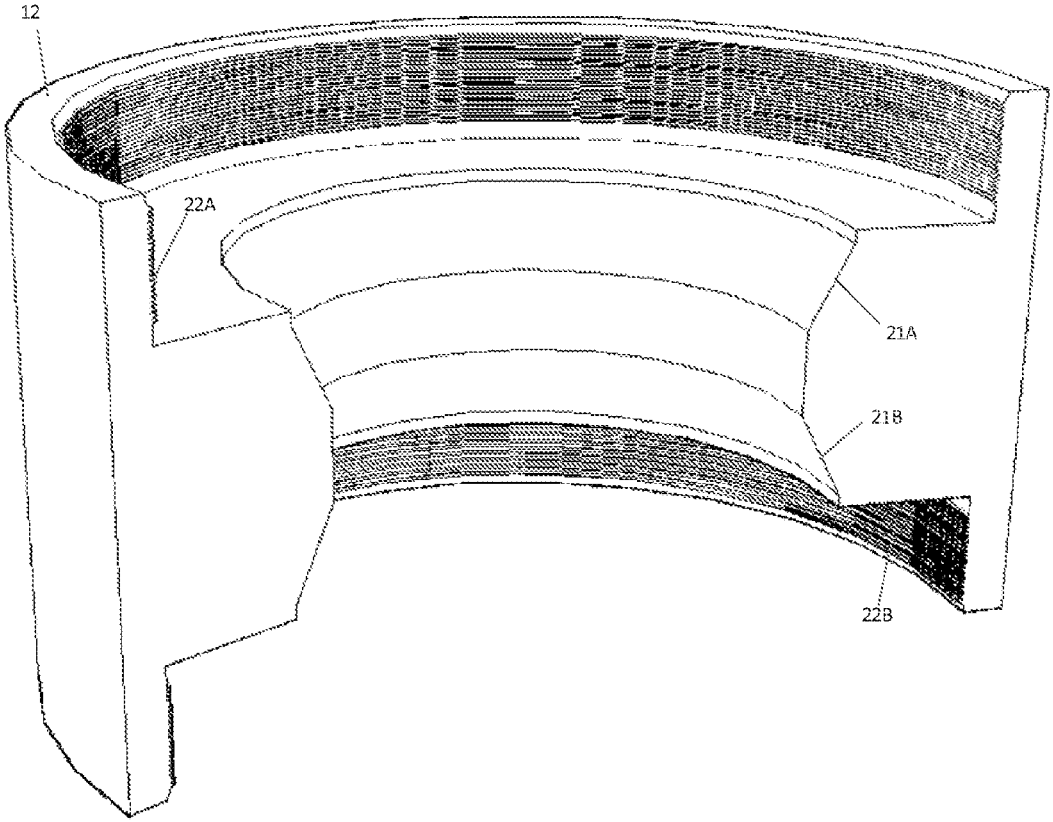
FIG. 2 is a diagram showing the cross-sectional view of the central coupler of an embodiment of the riser joint connection.

FIG. 2 shows that, in some implementations, the central coupler 12 has two sloped surfaces 21A and 21B at its inner side, and has threaded sections 22A and 22B at the two ends. In some implementations, the two sloped surfaces 21A and 21B are in contact with the surfaces of the ends of the riser joints to be connected and form a tight sealing to contain the internal passage of matters within the riser. In some implementations, the surfaces of the ends of the riser joints are sloped to create a tight seating against the inner sloped surfaces 21A and 2113 of the central coupler 12.

Figure 3:
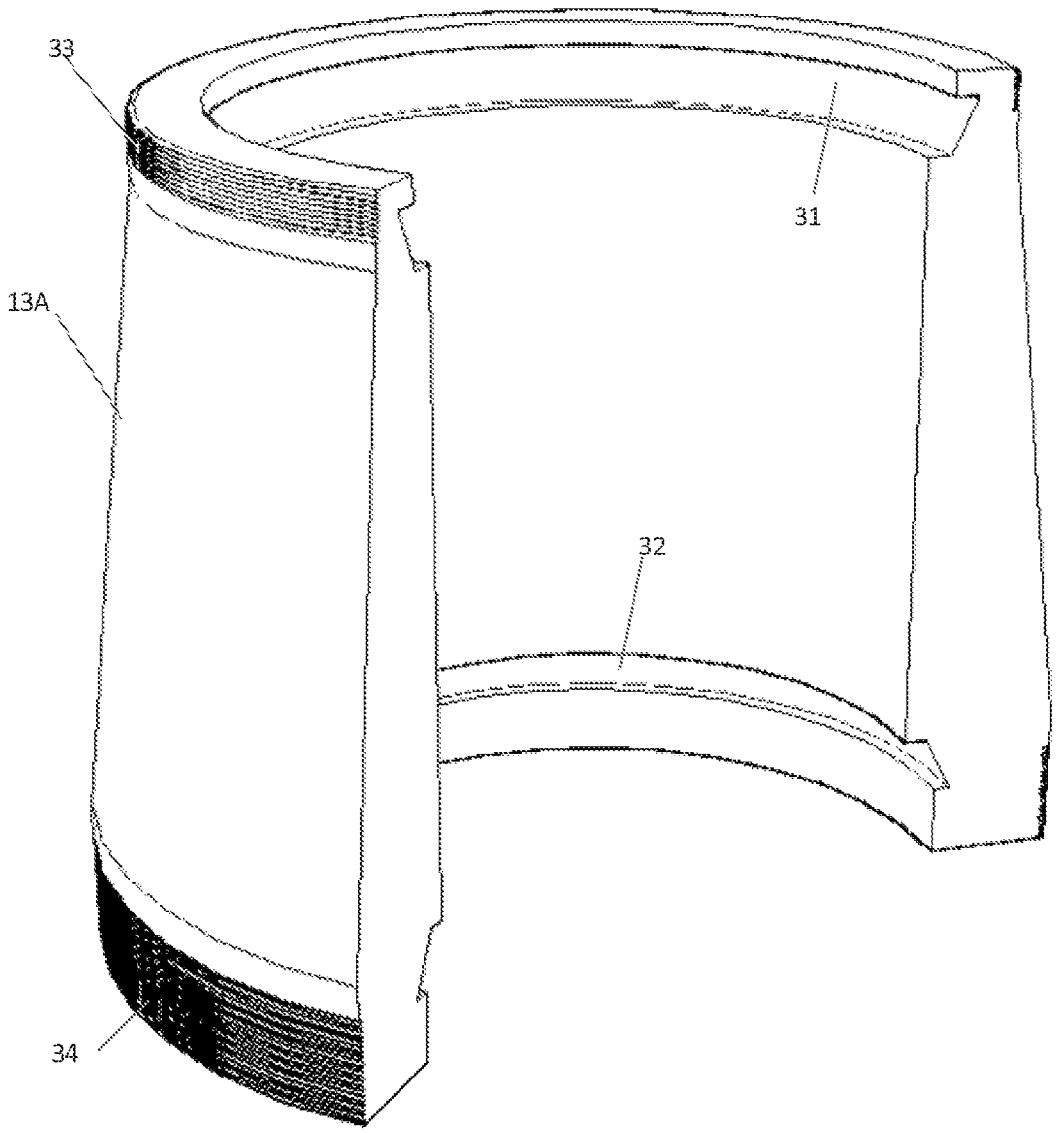
FIG. 3 is a diagram showing the cross-sectional view of the reaction collar of an embodiment of the riser joint connection.

FIG. 3 shows that, in some implementations, the reaction collar 13 has an upper groove 31, a lower groove 32, an upper threaded section 33, and a lower threaded section 34. In some implementations, the upper and lower grooves can have sloped walls, creating a wider side and a narrower side within the grooves for fitting the C-rings.

Figure 4:
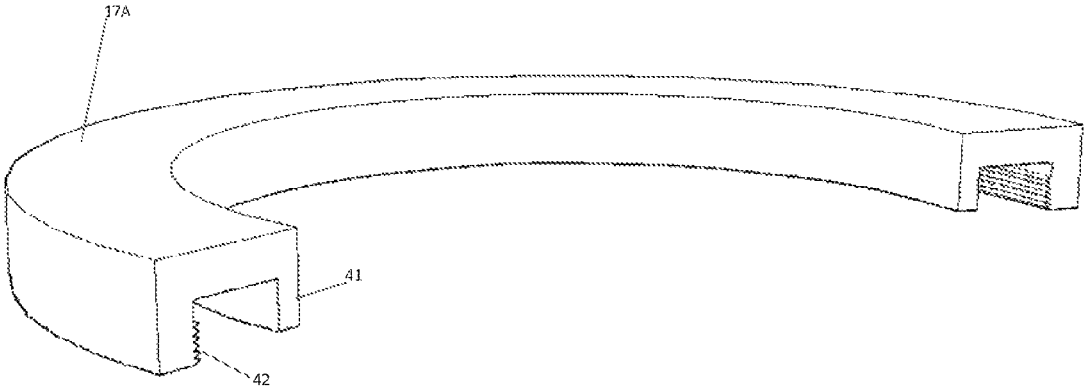
FIG. 4 is a diagram showing the cross-sectional view of the collar cap of an embodiment of the riser joint connection.

FIG. 4 shows that, in some implementations, the collar cap 17 has a C-ring locker 41 and a threaded section 42.

Figure 5:
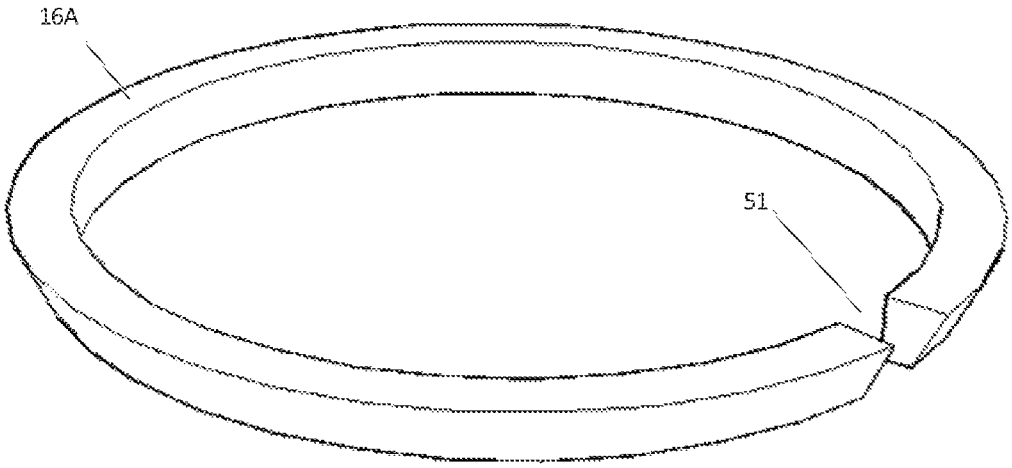
FIG. 5 is a diagram showing the C-ring of an embodiment of the riser joint connection.

FIG. 5 shows that, in some implementations, the C-ring 16 has a gap opening 51, which can allow the C-ring to reduce its diameter and fit on the riser surface when subject to external force. In some implementations, the C-ring has a tapered cross section, such that one end is wider than the other end.

In some implementations, the riser joint connection can be made as follows: (i) mount the C-rings 15 and 16 into the reaction collar 13; (ii) slide the collar cap 17 and reaction collar 13 onto the riser joint 11, then mount the collar stopper 14; (iii) align upper riser joint 11A and lower riser joint 11B, and insert the central coupler 12; (iv) torque the reaction collars 13 to a certain torque value, such that the riser joints 11 are pushed against the central coupler 12 tightly, and lower C-rings 15 are fitted tightly in the gap between the riser joints 11 outer surface and reaction collars 13; and (v) torque the collar caps 17 to a certain torque value, such that the upper C-rings 16 are fitted tightly in the gap between riser joints 11 outer surface and reaction collars 13.

In some implementations, the riser joints 11 can have their ends machined to have a sloped configuration that matches the inner sloped surfaces 21 of the central coupler 12. In some implementations, the sealing created by this kind of fitting can withstand a pressure rating up to 10,000 psi.

Other Embodiments

Various other adaptations and combinations of features of the embodiments and implementations disclosed are within the scope of the present disclosure. It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An apparatus for riser joint connection, comprising:

a central coupler defining:
- an upper internally threaded section;
- an upper inner sloped surface;
- a lower inner sloped surface; and
- a lower internally threaded section;

a first riser joint having a lower end inserted into the upper inner sloped surface of the central coupler;

a first collar stopper threaded around the lower end of the first riser joint;

a first upper C-ring and a first lower C-ring;

a first reaction collar fitted around the first riser joint, the first reaction collar defining:
- a first internal upper groove receiving the first upper C-ring;
- a first internal lower groove receiving the first lower C-ring;
- a first lower externally threaded section screwed into the upper internally threaded section of the central coupler; and
- a first upper externally threaded section;

a first collar cap threaded around the first upper externally threaded section of the first reaction collar;

a second riser joint having an upper end inserted into the lower inner sloped surface of the central coupler;

a second collar stopper threaded around the upper end of the second riser joint;

a second upper C-ring and a second lower C-ring;

a second reaction collar fitted around the second riser joint, the second reaction collar defining:

a second internal upper groove receiving the second upper C-ring;

a second internal lower groove receiving the second lower C-ring;

a second lower externally threaded section; and a second upper externally threaded section screwed into the lower internally threaded section of the central coupler; and a second collar cap threaded around the second lower externally threaded section of the second reaction collar.

2. An apparatus according to claim 1, wherein the first and the second riser joints are connected through the interlocking created by the central coupler, the first and the second reaction collars, the first and the second collar stoppers, the first and the second collar caps, and the first upper, the first lower, the second upper, and second lower C-rings.

3. An apparatus according to claim 2, wherein the upper inner and the lower inner sloped surfaces of the central coupler form a tight sealing with the lower end of the first riser joint and the upper end of the second riser joint to contain internal passage of matters within a riser.

4. An apparatus according to claim 3, wherein surfaces of the lower end of the first riser joint and the upper end of the second riser joint are sloped to create a tight sealing against the upper inner and the lower inner sloped surfaces of the central coupler.

5. An apparatus according to claim 2, wherein each groove has a sloped wall, such that a corresponding C-ring is loose when it is at the wider side of the groove, and is tight when it is at the narrower side of the groove.

6. An apparatus according to claim 5, wherein the first collar stopper is in contact with the first lower C-ring, which provides a load bearing surface pushing the first lower C-ring toward the narrower side of the first internal lower groove, and pushing the first riser joint toward the central coupler.

7. An apparatus according to claim 5, wherein the first collar cap has a C-ring locker for pushing the first lower C-ring toward the narrower side of the first internal lower groove.

8. An apparatus according to claim 2, wherein each C-ring has a gap opening allowing the C-ring to reduce its diameter and fit on a riser surface when subject to external force.

9. An apparatus according to claim 8, wherein each C-ring has a tapered cross section, with one end wider than the other end.

10. A method for riser joint connection, comprising:

mounting a first C-ring and a first lower C-ring into a first internal upper groove and a first internal lower groove of a first reaction collar;

sliding a first collar cap and a first reaction collar onto a first riser joint;

mounting a first collar stopper onto the first riser joint;

mounting a second upper C-ring and a second lower C-ring into a second internal upper groove and a second internal lower groove of a second reaction collar;

sliding a second collar cap and second reaction collar onto a second riser joint;

mounting a second collar stopper onto the second riser joint;

aligning the first and the second riser joints;

inserting a central coupler that connects with the first reaction collar and the first riser joint from the top and the second reaction collar and the second riser joint from the bottom;

torquing the first and the second reaction collars to a certain torque value, which pushes the first and the second riser joints against the central coupler tightly, and fits the first lower C-ring and the second upper C-ring between the first internal lower groove and the second internal upper grove of the first and the second reaction collars and the first and the second riser joints to a certain tightness; and torquing the first and the second collar caps to a certain torque value, which fits the first upper C-ring and the second lower C-ring between the first internal upper groove and the second internal lower groove of the first and the second reaction collars and the first and the second riser joints to a certain tightness.

11. A method according to claim 10, wherein the first reaction collar is connected with the central coupler and first collar cap through threaded sections.

12. A method according to claim 10, wherein the central coupler has upper and lower inner sloped surfaces, which are in contact with surfaces of a lower end of the first riser joint and an upper end of the second riser joint and form a tight sealing to contain internal passage of matters within a riser.

13. A method according to claim 10, wherein surfaces of a lower end of the first riser joints and an upper end of the second riser joint are sloped to create a tight sealing against upper and lower inner sloped surfaces of the central coupler.

14. A method according to claim 10, wherein each groove has a sloped wall, such that a corresponding C-ring is loose when it is at the wider side of the groove, and is tight when it is at the narrower side of the groove.

15. A method according to claim 14, wherein the first collar stopper is mounted onto an outer surface of the first riser joint through threads, and is in contact with the first lower C-ring, which provides a load bearing surface pushing the first lower C-ring toward the narrower side of the first internal lower groove, and for pushing the first riser joint toward the central coupler.

16. A method according to claim 14, wherein the first collar cap has a threaded section connected with the first reaction collar, and a C-ring locker for pushing the first lower C-ring toward the narrower side of the first internal lower groove.

17. A method according to claim 10, wherein each C-ring has a gap opening allowing the C-ring to reduce its diameter and fit on a riser surface when subject to external force.

18. A method according to claim 10, wherein each C-ring has a tapered cross section, with one end wider than the other end.

* * * * *